United States Patent [19]

Kawano et al.

[11] 4,138,871

[45] Feb. 13, 1979

[54] LIQUID PRESSURE EXTRUSION METHOD AND DEVICE FOR TUBE OR TUBULAR MEMBER

[75] Inventors: Hideo Kawano; Sadahiko Mitsugi; Oelhschlägel Dietrich; Kenkichi Yamaji, all of Hitachi, Japan

[73] Assignee: Hitachi Cable, Ltd., Japan

[21] Appl. No.: 800,873

[22] Filed: May 26, 1977

Related U.S. Application Data

[63] Continuation-in-part of Ser. No. 620,702, Oct. 8, 1975, abandoned.

[51] Int. Cl.[2] ..... B21D 22/10

[52] U.S. Cl. ..... 72/60; 72/269; 72/468

[58] Field of Search ..... 72/60, 57, 54, 264, 72/269, 467, 468

[56] References Cited

U.S. PATENT DOCUMENTS

| | | | |
|---|---|---|---|
| 293,600 | 2/1884 | Sloan | 72/269 |
| 2,031,008 | 2/1936 | Schwerak | 72/269 X |
| 2,135,194 | 11/1938 | Underhill | 72/269 |
| 2,673,645 | 3/1954 | Moczik | 72/269 X |
| 2,811,253 | 10/1957 | Schieren | 72/468 X |
| 3,457,760 | 7/1969 | Cassady et al. | 72/269 X |
| 3,767,368 | 10/1973 | Fuchs, Jr. | 72/60 |
| 3,910,085 | 10/1975 | Biddell | 72/60 |

*Primary Examiner*—Leon Gilden
*Attorney, Agent, or Firm*—Craig & Antonelli

[57] ABSTRACT

A liquid pressure extrusion method and device for extruding a billet into a tube or tubular member wherein combined dies are used for extruding a solid billet therethrough under a liquid pressure.

26 Claims, 10 Drawing Figures

LIQUID PRESSURE EXTRUSION METHOD AND DEVICE FOR TUBE OR TUBULAR MEMBER

RELATED APPLICATIONS

This application is a continuation-in-part of application Ser. No. 620,702 filed on Oct. 8, 1975 now abandoned.

BACKGROUND OF THE INVENTION

1. Field of the Invention

This invention relates to a liquid pressure extrusion method and device for extruding a billet into a tube or tubular member, in which combined dies, such as of a port-hole, bridge and spider type, are used.

2. Description of the Prior Art

Included in extrusion methods for extruding a tube or tubular member under a liquid pressure are (1) a mandrel fixed type, in which a mandrel is fixed relative to a hollow billet, and (2) a movable mandrel type, in which a mandrel is movable relative to a hollow billet.

The former finds a wide use in industries, because the mandrel serving as a reference core is stationary, presenting high accuracy for extrusions. However, this method suffers from a shortcoming in that the mandrel requires a support therefor, i.e., a sleeve, so that the stroke of a pressing ram is shortened to an extent corresponding to the length of the sleeve. This in turn leads to a decrease in the length of a billet which is extrudable, thus providing an extrusion of an amount half that of an extrusion obtained from a solid billet.

On the other hand, the latter method provides an advantage in that, unlike the former case, this dispenses with a mandrel support (sleeve), with the resulting freedom of the limitation of a length of a stroke of a pressing ram, thus enabling extrusion of a hollow billet into a tube of a desired length as in the case of a solid billet extrusion. However, this latter method poses a problem that the rear end face of a billet tends to move due to a pressure acting on the flange portion of a mandrel, on which the billet abuts, thus failing to maintain a consistent condition for the moving billet, in contrast to the case where the outer surface of a billet as a whole is directly subjected to a liquid pressure. As a result, this results in a slight inbalance or failure in balance between the inner and outer pressures acting on the extruding portion of dies, presenting difficulties in maintaining dimensional accuracy of an extrusion constant. In addition, after the completion of an extrusion, the mandrel remains pressed deep into the end of an extruded product, so that many man hours are required for withdrawing the mandrel from the end thereof. This apparently lowers the efficiency of operation as well as poses a difficulty to be solved by technology.

SUMMARY OF THE INVENTION

The present invention is directed to a method of and apparatus for extruding by the use of liquid pressure a solid billet into a tube or tubular member or further into such a member having fins in its inner surface extending along the length thereof by utilizing a port-hole type, bridge type, or spider type combined dies while eliminating the aforesaid drawbacks.

It is an object of the present invention to provide a liquid pressure extrusion method and device for a tube or tubular member, using a liquid pressure for extrusion, which enables the use of combined dies for extruding a solid billet, thereby improving productivity of the extrusion and facilitating a continuous extrusion of one billet after another.

It is another object of the present invention to provide a liquid pressure extrusion method and device for a tube or tubular member, which prevents ingress of a pressure medium into the interior of the secondary dies of the combined dies or into a plurality of communicating holes between the primary die portion and the secondary die portion, thereby insuring desired quality of extrusion in the form of tube or tubular member.

It is a further object of the present invention to provide a liquid pressure extrusion method and device for a tube or tubular member, which utilizes the advantage of liquid pressure extrusion of presenting good lubricity for smooth extrusion, with the resulting lowering in extruding pressure.

It is a still further object of the present invention to provide a liquid pressure extrusion method and device for a tube or tubular member, which produce tubes and tubular members having fins on their inner surfaces in a simple but reasonable manner, based on the aforesaid technical background.

These and other objects of the present invention may be attained by the liquid pressure extrusion method and device which use combined dies and a fixed type mandrel, as well as a liquid pressure, while solving the problem of shortened stroke of a pressing ra and a failure in balance in an extruding pressure which stems from the aforesaid prior art extrusion methods, and retaining the advantages of a fixed type mandrel extrusion method. To this end, there are incorporated the second and third features in the invention, in addition to the aforesaid first feature for presenting a wider application thereof.

According to the present invention, a solid billet being extruded under a liquid pressure accommodates its shape to the receiving inner circumferential surface of a primary die portion which includes a plurality of communicating holes leading to the secondary die portion, so that a billet is extruded into a tube or tubular member by being extruded through a gap defined between a depending end portion of a short mandrel secured to the primary die portion and the inner circumferential surface of the secondary die portion.

DESCRIPTION OF THE PREFERRED EMBODIMENTS

These and other objects and features of the present invention will be apparent from a reading of the ensuring part of the specification in conjunction with the accompanying drawings which show embodiments of the invention.

Figure 1:
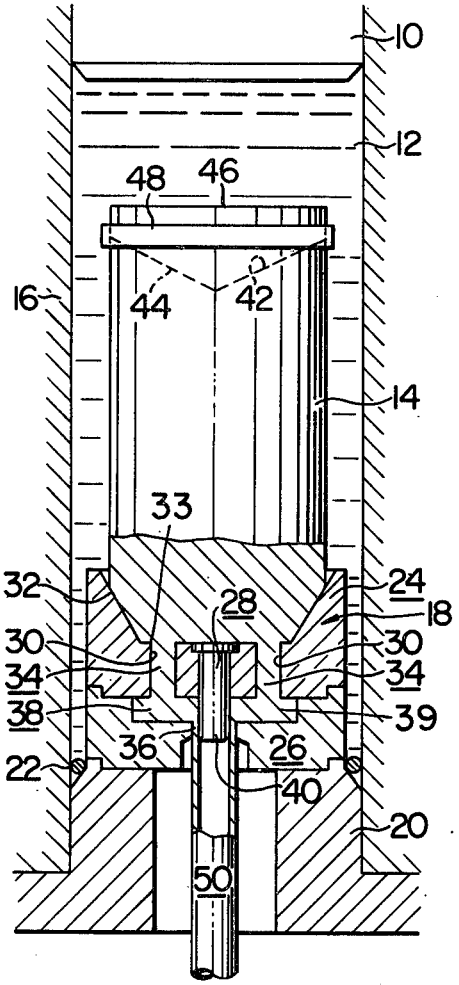
FIG. 1 is a partial longitudinal cross sectional view showing an extruding mode of a liquid pressure extrusion device using port-hole type, combined dies.

FIG. 1 shows a fundamental arrangement of the extrusion device according to the present invention. Shown at 10 is a stem, at 12 a pressure medium such as castor oil, at 14 a solid billet of a cylindrical shape, at 16 a container, at 18 a port-hole type combined dies, at 20 a die support, at 22 a seal.

Figure 3:
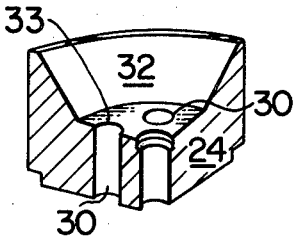
FIG. 3 is a perspective, cut-away view of a port-hole type, combined die.

The aforesaid combined dies 18 consist of a primary die portion 24, a secondary die portion 26 and a fixed type mandrel 28 of a short length. Shown at 30, 30 . . . are longitudinally extending communicating holes, which are referred to as port holes herein, as shown in FIG. 3. The top opening of the port holes 30 are communicated with the bottom portion of a recess defined by a conical inner circumferential surface 32 of the primary die portion, wherein a billet is subjected to squeezing deformation, while its lower opening is communicated with a columnar cavity 38, in which the divisions 34, 34 . . . of the billet which are being produced in the port holes are united and fused together, and then a body thus united is fed to a die hole 36 in the secondary die portion 26.

Due to the lubricative characteristic of the pressure medium present around the billet and dies, the problem of the pressure medium entering into the port holes 30 together with the billet material undergoing plastic deformation, and mixing with the streams of material therein and thus preventing the separated material from recombining and welding together in a recombining chamber such as the columnar cavity 38, must be avoided to enable production of a tube in this manner. This problem is avoided in the present invention since the conical billet-squeezing surface 32, which is complementary in shape to the shape of the front end of the billet, has a flat bottom surface 33. This flat bottom surface 33 acts to restrain the flow of the outer portion of the billet which is in contact with the pressure medium and together with the force acting on the billet to press it downwards, the flat bottom surface 33 effectively prevents the pressure medium from entering the port holes 30.

It is also noted that the columnar cavity 38 has a portion 39 extending radially outwardly beyond the outer extremity of the peripheries of the port holes 30. This radially spreading portion 39 of the columnar cavity 38 makes the cross sectional area of the cavity large, and therefore, the ratio of reduction at the extrusion of the tube becomes large and this results in better unity of the material forming the product. Further, at the portion 39, since the pressure of the material acts reversely on the primary die portion 24, particularly in the region of the surface 33, the stress applied to the portion around the port holes of the primary die portion is effectively reduced.

The cross sectional configurations of those port-holes 30, 31 . . . are in general of a circular shape or an elliptic shape having a major axis in the circumferential direction.

The fixed type mandrel 28 is fitted and secured in the center of the primary die portion 24, with its depending end portion 40 positioned within the die hole 36 of the secondary die portion 26, while leaving an annular gap between the end portion 40 and the inner circumferential surface of the die, which defines the die hole 36, the aforesaid gap corresponding to the wall thickness of a tube or tubular member to be produced.

On the other hand, a concave portion 42 of a conical shape is formed by machining in the end face of the billet 14, while a plug 46 having a flat top surface and a lower portion 44 of a conical shape complimentary with the aforesaid concave portion 42 is fitted in the concave portion 42. On the other hand, a tape 48 is wound around a billet along the boundary between the end portion of the billet and the plug 46 for preventing ingress of the pressure medium 12 therein.

In operation, the stem 10 is first lowered to compress the pressure medium 12, so that the pressure of the pressure medium 12 is increased. When the pressure reaches an extrudable pressure, then the tip portion of the billet 14 abuts the conical shaped squeezing inner surface 32 of the primary die portion 24, and is then squeezed therein, presenting the initial stage of extrusion.

Upon the establishment of the first stage extrusion within the primary die portion 24, the billet 14 is maintained in its normal condition, and extruded under an increasing extrusion pressure of the pressure medium 12, with the aid of the lubricating action of the pressure medium 12, after which the billet 14 is divided into a plurality of divisions 34, 34 . . . through the port-holes 30, 30 . . . Then, the divisions 34, 34 . . . of the billet 14 are introduced into a columnar cavity 38 for being united, followed by feeding into a gap defined between the depending end portion 40 of the mandrel 28 and the inner surface of the secondary die, which defines the die hole 36, thereby providing a tube or tubular member 50.

In this manner, during the time, in which a downward pressure is being applied to the billet 14, the tube continues to be extruded according to a fixed type mandrel method, and eventually there will be left a residual portion 52 of the billet, which is of a small mass, thus completing the first time extrusion.

In this respect, for achieving a continuous extrusion, the stem 10 is retracted in the final stage or a stage before the final stage of extrusion, the tape 48 is unwound to allow the removal of the plug 46 from the end face of the billet, then a fresh billet 14 is charged in the container 16, with its tip fitted in the concave portion 42 in the rear end face of the residual portion 52 of the preceding billet, and a pressure is again applied to the fresh billet for continuing the extrusion in the aforesaid manner. In this respect, the tip portion of the fresh billet may be joined to the rear end face of the preceding billet according to a known method such as welding or the use of a seal tape.

Figure 4:
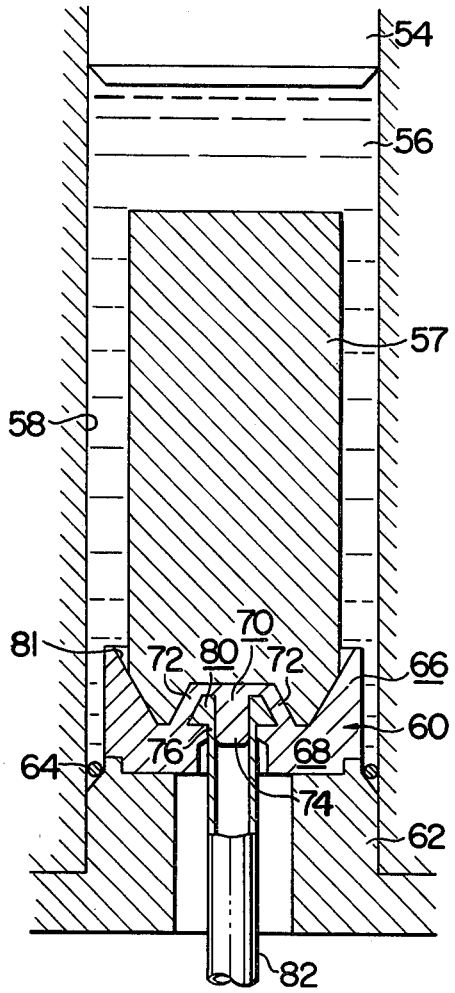
FIG. 4 is a partial longitudinal cross sectional view showing an extruding mode of a billet according to a liquid pressure extrusion device using a bridge type, combined die.

FIG. 4 shows an example, wherein there is used a bridge type, combined die.

Shown at 54 therein is a stem, at 56 a pressure medium, at 57 a cylindrical solid billet, at 58 a container, at 60 a bridge type, combined die, at 62 a die support, and at 64 a seal.

The combined die 60 consist of a primary die portion 66, a secondary die portion 68 and a fixed type mandrel 70 of a short length.

The fixed type mandrel 70 is formed with a plurality of supporting legs 72, 72 . . . , and secured to the bottom portion of the primary die portion 66, with its depending end portion 74 positioned within a die hole 76 in the secondary die portion 68, which hole 76 is defined internally of the supporting legs 72, 72 . . . , while there is defined an annular gap between the depending end portion 74 and the inner surface of the secondary die, which defines the aforesaid die hole 76, so that a tube or tubular member may be extruded through the aforesaid gap.

Figure 5:
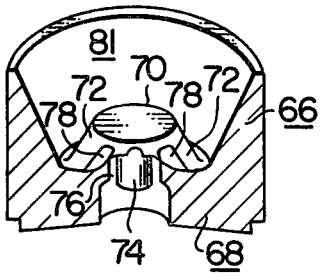
FIG. 5 is a perspective, cut-away view of a bridge type, combined die.

The gaps 78, 78 . . . defined among the plurality of supporting legs 72, 72 . . . as shown in FIG. 5 correspond to the communicating holes, or port-holes of the port-hole type combined die 18 of FIG. 1.

A small cavity 90 defined internally of the supporting legs 72, 72 . . . corresponds to the billet collection cavity 38 in the port-hole type die.

In operation, a solid billet 57 abuts the conical shaped squeezing surface 81 of the primary die portion 66, and is squeezed therein, and then divided into a plurality of divisions through the communicating holes 78, 78 . . . defined among the supporting legs 72, 72 . . . , after which the divisions are introduced into a cavity 80 for being united and then fed into the annular gap defined between the depending end portion 74 of the mandrel 70 and the inner wall of the secondary die, which defines the die hole 76, for extrusion into a tube or tubular member 82.

Figure 2:
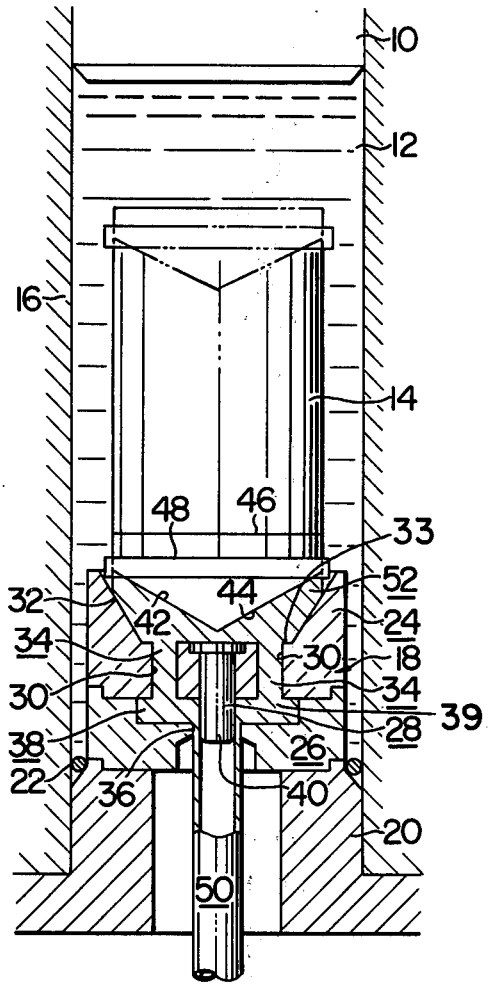
FIG. 2 is a partial longitudinal cross sectional view showing the condition of a billet ready for being pressed with a succeeding billet in a continuous manner, in the aforesaid device.

Meanwhile, when the rear end portion of the billet 57 is so shaped as to accommodate itself to the succeeding extrusion of a fresh billet, as in the case of FIG. 2, a successive extrusion may be performed.

As is clear from the description of the port-hole type and bridge type combined dies shown in FIGS. 1 and 4, the ingress along the conical squeezing surfaces 32, 81, then along a plurality of solid billet divisions formed through the port holes 30, 30 . . . and communicating holes 78, 78 . . . , then into the billet collective cavities 38, 80, and eventually into the billet material of pressure oil should be avoided.

Figure 6:
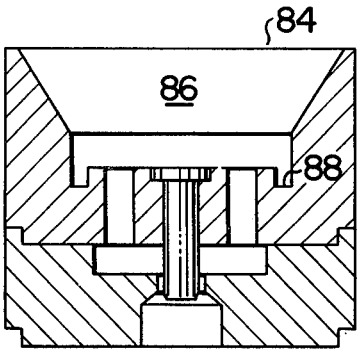
FIGS. 6, 7, 8, and 9 are partial, cross sectional views showing combined dies according to the present invention, respectively.
Figure 7:
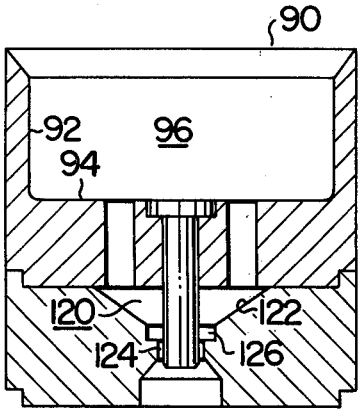
Figure 8:
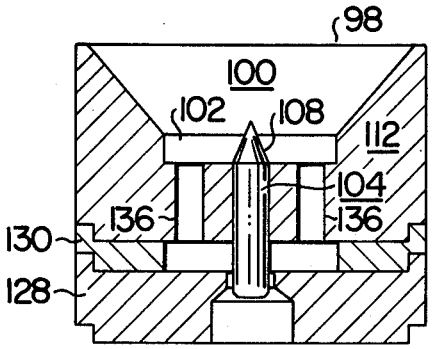

FIGS. 6, 7 and 8 show the improvements over the aforesaid arrangement with respect to the aforesaid shortcomings.

Dies 84 shown in FIG. 6 are formed with a trap or concave groove 88 in a suitable position in the conical squeezing surface 86, while dies 90 shown in FIG. 7 are formed with a cylindrical billet receiving surface 96 consisting of a flat bottom surface 94 and a straight wall portion 92 extending in the extruding direction of a billet. On the other hand, dies 98 shown in FIG. 8 are formed with a conical squeezing surface 100 having a cylindrical flat-bottomed small space 102 below the aforesaid surface 100 which is contiguous thereto.

These concave groove 88, cylindrical flat-bottomed receiving surface 96 and space 102 exhibit effects equivalent to that of a known dead metal zone as has been used in the extrusion, thereby trapping pressure oil therein for avoiding the aforesaid shortcomings.

Figure 9:
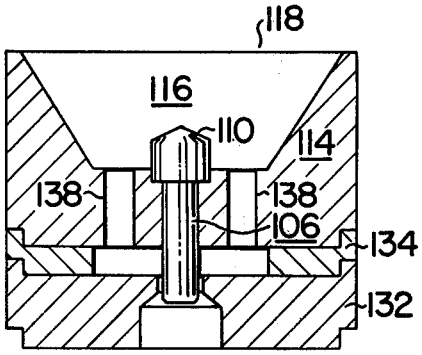

FIGS. 8 and 9 refer to the improvements in the combined dies for reducing an extruding pressure by rendering the flow of a billet smooth.

More specifically, the provision of sharpened heads 108 and 110 of the fixed type mandrels 104 and 106 are so contemplated as to eliminate the dwelling of the flow of a billet thereat, which tends to take place in the center portions of the billet receiving surfaces 100, 116 of the primary dies portions 112 and 114.

The configuration of the sharpened head 108 of the mandrel 104 may be of a conical or pyramid shape, while that of the combined dies 118 of FIG. 9 gives a combination of a conical or pyramid shape with a circular cylinder.

The sharpened heads 108 and 110 occupy the bottom center portions of the conical squeezing surfaces 100 and 116, while the conical side surfaces of the heads face the surfaces 100 and 106.

With the aforesaid arrangement, the bottom center portions of the surfaces 100 and 116 are occupied by the head portions 108, 110, so that the tip of the billet is subjected to a dividing action in the aforesaid center portions, whereby the billet is divided at those heads 108, 110 and then flows along the side surfaces thereof, so the tendency of a billet to dwell may be effectively avoided. This action aids in reducing extrusion pressure and has been supported by many experiments.

A cavity 120 defined in the combined dies 90 as shown in FIG. 7 is formed with a conical inner surface 122, thus effectively reducing an extruding pressure. In addition, the provision of a small shoulder or stepped portion 126 provided in the neighborhood of die hole 126 makes a billet slide during extrusion, thus improving the quality of extrusions.

The final operation of the extrusion of a tube or tubular member is to remove the residual portion of a billet in the container. FIGS. 8 and 9 illustrate the feasibility of this removal operation.

As shown in FIGS. 8 and 9, a die support 128 and an intermediate spacer member 130 and die support 132 and an intermediate member 134 may be independently slide from the representive positions, so that the divisions of a billet which clog the communicating holes 136, 136 . . . and 138, 138, . . . may be cut, after the aforesaid sliding or removal of the dies support and spacer member. This facilitates to release the dies in its entirety.

Figure 10:
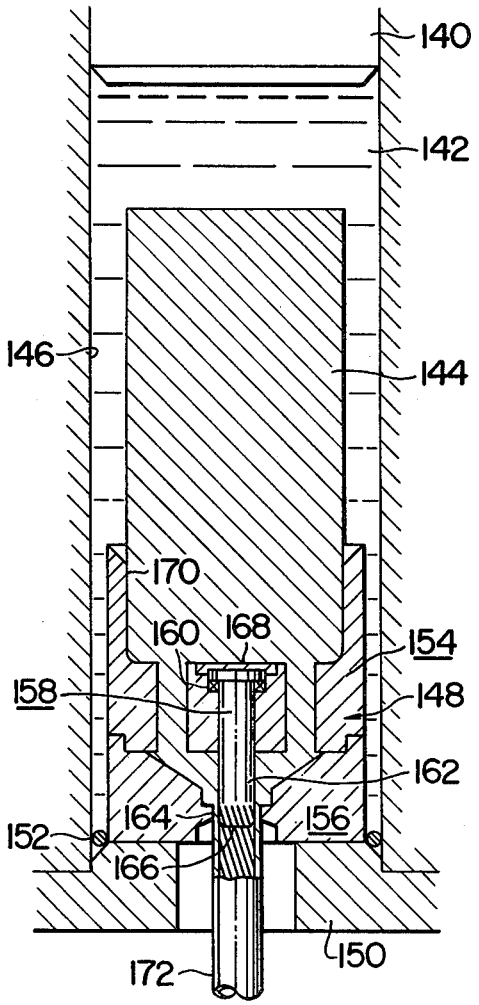
FIG. 10 is a partial longitudinal cross sectional view showing an extruding mode of a billet in the liquid pressure extrusion device using combined dies having a fixed type madrel formed with grooves in the surface of a depending portion of the fixed type mandrel.

FIG. 10 shows the extrusion of tubes and tubular members having fins on their inner surfaces through a port-hole type combined die of a special arrangement. This attempt corresponds to the modification of the fundamental embodiment of the present invention.

In FIG. 10, shown at 140 a stem, at 142 a pressure medium, at 144 a cylindrical solid billet, at 146 a container, at 148 a port-hole type combined dies, at 150 a dies support, and at 152 a seal.

The combined dies 148 consist of a primary die portion 154, a secondary die portion 156 and a fixed type mandrel 158 of a short length. In this respect, the fixed type mandrel 158 is maintained stationary relative to an extruding direction, while it is rotatably supported with respect to the axis of the die by means of a bearing 160 and the like. The depending portion 162 thereof is positioned within a die hole 164 in the secondary die portion 156 and formed with straight or sprial formed grooves 166 extending in the axial direction, in the circumferential surface of the depending end portion 162. Shown at 168 is a cover member positioned on top of the fixed type mandrel 158, and the opposite surface of the cover member faces a billet receiving surface 170 of the primary die portion 154. With the aforesaid arrangement, a billet 144 which is pressed into a gap defined between the depending portion 162 of the mandrel 158 and the inner surface of the secondary die portion 156, which defines a die hole 164 is extruded, being accompanied by an appropriate rotation of the mandrel 158, thereby providing a tube or tubular member 172 having fins on its inner surface.

Accordingly, a tube having internal fins may be extruded, without rotating a billet forcibly, so that there may be achieved a simple and efficient extruding operation, which allows the extrusion of a internally fined tube or tubular member of a considerable length.

The cover member 168 is positioned between the billet and the mandrel 158 so as to prevent the adverse influence of the rotation of the mandrel on the flow of the billet 144 by blocking the direct contact of the billet from the function of the mandrel 158.

We claim:

1. A liquid pressure extrusion method for producing a tube or tubular member, comprising the steps of: bringing a solid billet, being pressed under a liquid pressure, into abutment with a billet receiving surface and then with a flat portion of a primary die portion, said flat portion extending transversely with respect to the direction of extrusion at the end of said billet receiving surface; introducing said billet separately through a plurality of port-holes or communicating holes downstream in the direction of extrusion with respect to said flat portion leading to a secondary die portion; and then extruding said billet into a tube through a gap defined between a depending end portion of a fixed type short mandrel supported by said primary die portion and a die hole formed in a flat bottom of said columnar cavity of said secondary die portion.

2. A liquid pressure extrusion method as defined in claim 1, wherein the fixed pipe mandrel is formed with a sharp-pointed head portion positioned with at least a part thereof within a billet-receiving surface of the primary die portion, and wherein the method further comprises the step of separating the billet being extruded at the sharp-pointed head portion of the mandrel.

3. A liquid pressure extrusion method as defined in claim 1, further comprising the step of interposing a separate annular spacer member between the primary die portion and the secondary die portion.

4. A liquid pressure extrusion method as defined in claim 1, wherein the depending end portion of the fixed type mandrel is formed with at least one of a straight and spiral grooves extending in the axial direction of the mandrel whereby, upon extrusion of the billet, the tube or tubular member formed is provided with fins on its inner surface.

5. A liquid pressure extrusion method as defined in claim 4, further comprising the steps of fixing the mandrel relative to the extrusion direction of the billet and rotatably supporting the mandrel with respect to the axis of the primary and secondary die portions.

6. A liquid pressure extrusion method as defined in claim 4, further comprising the step of covering the head of the mandrel so as to prevent adverse influence of the rotation of the mandrel on the flow of the billet.

7. A liquid pressure extrusion method as defined in claim 1, wherein said depending end portion of said fixed type mandrel is formed with a straight or spiral grooves extending in the axial direction of said mandrel.

8. A liquid pressure extrusion method as defined in claim 1, wherein said primary die portion is provided with a conical billet-squeezing surface and an annular groove, and wherein the method further comprises trapping a pressure medium in the annular groove formed in the billet-squeezing surface.

9. A liquid pressure extrusion method for producing a tube or tubular member, comprising the steps of: bringing a solid billet, being pressed under a liquid pressure, into abutment with a billet receiving surface and then with a flat portion of a primary die portion; introducing said billet separately through a plurality of port-holes or communicating holes leading to a secondary die portion; and then extruding said billet into a tube through a gap defined between a depending end portion of a fixed type short mandrel supported by said primary die portion and a die hole formed in a flat bottom of said columnar cavity of said secondary die portion, wherein a rear end face of said billet is formed with a concave recess therein, and a plug member is fitted therein for providing a flat top-end surface of said billet for a first extrusion, further comprising the steps of: removing the plug member from the billet, inserting a tip of a succeeding billet into said concave recess upon a succeeding extrusion for achieving a successive extruding operation.

10. A liquid pressure extrusion device for producing a tube or tubular member, comprising combined dies secured to one end of a container and consisting of a primary die portion having a billet receiving surface and flat billet engaging portion, said flat portion extending transversely with respect to the direction of extrusion at the end of the billet receiving surface, a secondary die portion having a columnar recombining cavity, and a fixed type short mandrel having a depending end portion extending in an extruding direction of a billet and supported by said primary die portion, said combined dies including a plurality of port-holes or communicating holes downstream in the direction of extrusion with respect to said flat portion, said holes communicating an inlet side of said primary die portion with said secondary die portion, and said depending end portion of said fixed type mandrel being positioned within a die hole across a flat bottom of said columnar cavity of said secondary die portion, whereby there is defined a gap between said depending end portion of said mandrel and the inner wall of said secondary die portion, which wall defines said die hole therein, thereby extruding a billet through said gap into a tube or tubular member.

11. A liquid pressure extrusion device as defined in claim 10, wherein said primary die portion is provided with a conical billet-squeezing surface and an annular groove for trapping a pressure medium therein is formed in the billet-squeezing surface.

12. A liquid pressure extrusion device as defined in claim 10, wherein said fixed type mandrel is formed with a sharpened head portion acting so as to separate said billet being extruded thereat, said head portion being positioned in its part or in its majority within a billet-receiving cavity in said primary die portion, said cavity defining the billet-receiving surface of said primary die portion.

13. A liquid pressure extrusion device as defined in claim 12, wherein said sharp end head portion of said mandrel is of a conical, pyramid shape or a combination thereof with a cylinder.

14. A liquid pressure extrusion device as defined in claim 5, wherein a spacer member is interposed between said primary die portion and said secondary die portion for separating the two die portions and for defining a billet collection cavity therebetween.

15. A liquid pressure extrusion device as defined in claim 10, wherein said depending portion of said fixed type mandrel is formed with straight or spiral grooves extending in the axial direction of said mandrel.

16. A liquid pressure extrusion device as defined in claim 15, wherein said fixed type mandrel is stationary relative to the extruding direction of a billet but rotatably supported with respect to the axis of said dies.

17. A liquid pressure extrusion device as defined in claim 15, wherein the head of said fixed type mandrel faces said billet-receiving cavity of said primary die portion through the medium of a cover covering the top of said mandrel.

18. A liquid pressure extrusion method for a tube or tubular member, comprising the steps of: bringing a solid billet being pressed under a liquid pressure, into abutment with a billet receiving surface of a primary die portion; introducing said billet through a plurality of port-holes or communicating holes leading to a secondary die portion; and then extruding said billet through a gap defined between a depending end portion of a fixed type short mandrel supported and built in said primary die, and the inner wall of said secondary die portion, which wall defines a die hole therein and further comprising the steps of providing said primary die portion with a conical billet-squeezing surface and an inner circumferential surface extending from said conical surface radially inwardly across the extruding direction of the billet.

19. An arrangement for extruding a tube from a billet by the application of pressure to the billet by a fluid comprising: a combined die means arranged at an open end of a container, said die means including a primary die portion, a secondary die portion and a fixed short mandrel having an end portion extending in an extruding direction of a billet and supported by said primary die portion, means for communicating an inlet side of said primary die portion, with said secondary die portion in a plurality of points, surface means on a peripheral wall of said primary die portion and extending radially inwardly therefrom for preventing the pressure applying fluid from entering the means for communicating, and a die hole provided in a secondary die portion for receiving said end portion of said mandrel, said die hole having a larger cross-sectional dimension than said end portion of said mandrel such that a gap is defined between said end portion of said mandrel and an inner wall of said secondary die portion through which gap a billet is extruded into a tube-shaped member.

20. An arrangement according to claim 19, wherein said surface means includes the provision of a conical billet-squeezing surface and a flat inner circumferential surface extending across the extruding direction of the billet on said primary die portion.

21. An arrangement according to claim 19, wherein a rear end face of the billet is provided with a concave recess therein, a removable plug means is receivable in said concave recess so as to provide a flat top-end surface for the billet such that, upon removal of the plug means, a tip of a succeeding billet is receivable in said concave recess upon a succeeding extrusion operation, thereby permitting successive extruding operations.

22. An arrangement according to claim 19, wherein said primary die portion includes a billet-receiving cavity, said secondary die portion includes a re-combining cavity, said communicating means terminates respectively in said billet-receiving cavity and said billet-collection cavity, and said re-combining cavity extends radially beyond said communicating means so that material in said re-combining cavity may act on the primary die portion reversely to that in said billet-receiving cavity.

23. A liquid pressure extrusion device as defined in claim 3, wherein said columnar cavity is positioned next to and downstream of said communicating holes in the extrusion direction, and said columnar cavity extends radially beyond the peripheries of said holes.

24. An arrangement according to claim 22, wherein said billet-receiving cavity is bounded at least in part by a conical surface.

25. An arrangement according to claim 24, wherein said re-combining cavity is columnar in shape.

26. A liquid pressure extrusion method for producing a tube or tubular member, comprising the steps of: bringing a solid billet, being pressed under a liquid pressure, into abutment with a billet receiving surface and then with a flat portion of a primary die portion; introducing said billet separately through a plurality of port-holes or communicating holes, leading to a secondary die portion and then extruding said billet into a tube through a gap defined between a depending end portion of a fixed type short mandrel supported by said primary die portion and a die hole formed in a flat bottom of said columnar cavity of said secondary die portion, including the steps of placing a plug having a conically shaped portion on an end of said billet, and winding a tape around adjoining portions of said billet and said plug for preventing entry of the pressure medium therebetween.

* * * * *